US008490450B2

(12) United States Patent
Yamane

(10) Patent No.: US 8,490,450 B2
(45) Date of Patent: Jul. 23, 2013

(54) RETRACT MANDREL MILL AND METHOD FOR ROLLING TUBE BLANK

(75) Inventor: Akihito Yamane, Kyoto (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/425,857

(22) Filed: Mar. 21, 2012

(65) Prior Publication Data

US 2012/0174646 A1 Jul. 12, 2012

Related U.S. Application Data

(63) Continuation of application No. PCT/JP2010/005368, filed on Sep. 1, 2010.

(30) Foreign Application Priority Data

Sep. 30, 2009 (JP) ..... 2009-225951

(51) Int. Cl.
*B21B 17/02* (2006.01)

(52) U.S. Cl.
USPC ..... 72/208; 72/96; 72/209

(58) Field of Classification Search
USPC ..... 72/208, 209, 224, 235, 365.2, 366.2, 72/367.1, 370.01, 370.17, 96, 97, 226, 234, 72/237, 238
See application file for complete search history.

(56) References Cited

U.S. PATENT DOCUMENTS

| | | | | |
|---|---|---|---|---|
| 3,874,212 | A * | 4/1975 | Nosal et al. | 72/209 |
| 4,044,584 | A * | 8/1977 | Korshunov | 72/214 |
| 4,375,160 | A * | 3/1983 | Verdickt | 72/208 |
| 5,513,511 | A * | 5/1996 | Imae et al. | 72/208 |

FOREIGN PATENT DOCUMENTS

| | | |
|---|---|---|
| JP | 7-214110 | 8/1995 |
| JP | 8-117816 | 5/1996 |
| JP | 8-300013 | 11/1996 |
| JP | 2001-205323 | 7/2001 |
| JP | 2008221238 A * | 9/2008 |

OTHER PUBLICATIONS

Machine Translation of JP 2001-205323 A from JPO.*

* cited by examiner

*Primary Examiner* — Dana Ross
*Assistant Examiner* — Pradeep C Battula
(74) *Attorney, Agent, or Firm* — Clark & Brody

(57) ABSTRACT

A retract mandrel mill, comprising a mandrel mill and an extractor, the mandrel mill including a mandrel bar and being configured to roll a tube blank into which the mandrel bar is inserted, the extractor being configured to extract the mandrel bar from the tube blank that has been rolled in the mandrel mill, wherein the distance between the mandrel mill and the extractor is adjustable, and a method for rolling a tube blank by using the retract mandrel mill. As the result of the adjustable distance, even when a tube blank which is shorter than usual is rolled, there is no need to add an extra extension to the length of the tube blank to be elongation-rolled, and the wear of the mandrel bar can be suppressed so that the tube blank can be rolled efficiently and with high yields.

4 Claims, 2 Drawing Sheets

PRIOR ART

RETRACT MANDREL MILL AND METHOD FOR ROLLING TUBE BLANK

TECHNICAL FIELD

The present invention relates to a retract mandrel mill which does not need an extra extension to be added to the length of a tube blank that is subjected to an elongation-rolling process when producing a shorter-length product than usual, and which can suppress the wear of the mandrel bar. The present invention also relates to a method for rolling a tube blank by using the aforementioned retract mandrel mill.

In the present description, a retract mandrel mill is an elongation-rolling apparatus that includes a mandrel mill and an extractor. As such an extractor, a sizing mill can also be used. When a typical extractor is used, a reducing-rolling mill is used to finish the outer diameter of the tube blank extracted by the extractor into a predetermined size. When a sizing mill is used, the tube blank is extracted and its outer diameter is finished into a predetermined size by the sizing mill.

BACKGROUND ART

In the past, a retract mandrel mill has been used to produce a seamless tube by a rolling process. Among prior arts, instances of using a retract mandrel mill are included in Patent Literatures 1 to 4.

[Configuration of Retract Mandrel Mill]

FIG. 1 is a configuration diagram of a conventional retract mandrel mill. As shown in FIG. 1, the retract mandrel mill includes a mandrel mill 10 which is a main rolling machine, and an extractor 20 which has the function of extracting a mandrel bar. In FIG. 1, the direction in which a tube blank 30 is rolled is indicated by an arrow A direction (hereafter, simply referred to as "rolling direction").

The mandrel mill 10 includes a mandrel bar 11 and a plurality of rolls 12. A restraint mechanism 13 is provided at the end area on the entrance side (upstream in the rolling direction) of the mandrel mill 10. The mandrel bar 11 during a rolling operation advances in the rolling direction while being retained by the restraint mechanism 13, and retreats by the action of the restraint mechanism 13 after the rolling is completed.

The extractor 20 is disposed at the exit side (downstream in the rolling direction) of the mandrel mill 10 in series with the mandrel mill 10. The extractor 20 includes a plurality of rolls 22 in a housing 21.

[Method for Rolling Tube Blank]

When the tube blank 30 is rolled as the starting material for a seamless tube, the tube blank 30 is inserted with the mandrel bar 11 in the mandrel mill 10 and is rolled by means of the mandrel bar 11 and rolls 12. The mandrel bar 11 advances together with the tube blank when the tube blank 30 is rolled, and retreats to an initial position by the action of the restraint mechanism 13 after the rolling has ended.

Since the tube blank 30 rolled by the mandrel mill 10 is forced by the rolls 22 of the extractor 20 to advance in the rolling direction and the mandrel bar 11 is subject to the force exerted by the restraint mechanism 13 in the direction opposite to the advancing direction of the tube blank, the tube blank 30 can be separated from the mandrel bar 11. This operation is called as stripping.

In order to prohibit the mandrel bar 11 from intruding into the extractor 20, it is necessary to arrange that the distance between the mandrel mill 10 and the extractor 20 is no less than an amount that is obtained by an expression: (speed of mandrel bar)×(rolling time in the final roll of the mandrel mill). Since the rolling time in the final roll of the mandrel mill is proportionate to the length of the tube blank to be rolled in the mandrel mill, the distance between the mandrel mill 10 and the extractor 20 is proportionate to the speed of the mandrel bar and the length of the tube blank to be rolled in the mandrel mill.

In a conventional retract mandrel mill, the distance between the mandrel mill 10 and the extractor 20 is set according to the maximum length of the tube blank 30 to be rolled in the mandrel mill. Both of the mandrel mill 10 and the extractor 20 are fixedly disposed so that the distance between the mandrel mill 10 and the extractor 20 is not adjustable.

FIG. 2 is a diagram to illustrate a state where a tube blank, which is shorter than the distance between the mandrel mill and the extractor, is rolled in a conventional retract mandrel mill. FIG. 2A shows a state of rolling procedure at a mandrel mill, FIG. 2B shows a state where stripping is performed by using an extract fork, FIG. 2C shows a state where the tube blank after being rolled in the mandrel mill is moved by the mandrel bar, and FIG. 2D shows a state where the overlap between the mandrel bar and the tube blank is reduced.

When a tube blank 30 which is shorter than the distance between the mandrel mill and the extractor is rolled in a conventional retract mandrel mill, that is, a retract mandrel mill in which the distance between the mandrel mill 10 and the extractor 20 is not adjustable, the front end of the tube blank 30 does not reach the extractor 20 after the rolling in the mandrel mill 10 has ended as shown in FIG. 2A.

In such a case, to make the tube blank 30 reach the extractor 20, and also to extract the mandrel bar 11 from the tube blank 30 (to perform stripping), the following three methods are applied.

(1) Regardless of the length required as a product, the tube blank 30 is produced with an extra length such that the length of the tube blank 30 after being rolled in the mandrel mill 10 is longer than the distance between the mandrel mill 10 and the extractor 20. Then, the excess part of the tube blank 30 is cut off in a subsequent step after the mandrel bar 11 is extracted from the tube blank 30 with the extractor.

However, in the method of (1) described above, since it is necessary to produce a tube blank having a length longer than the length needed for a product, there occurs a decrease in the yield of starting material and an excessive energy consumption.

(2) As shown in FIG. 2B, the mandrel bar 11 is forced to retreat while the tube blank 30 is prohibited from moving in the direction opposite to the rolling direction by using the extract fork 14, thereby performing stripping. Thereafter, the tube blank 30 is conveyed to the extractor 20 by conveyor rolls 15.

(3) As shown in FIG. 2C the tube blank 30 after rolling is conveyed by the mandrel bar 11 until when its front end comes into contact with a roll 22 on the entrance side of the extractor 20. Thereafter, the mandrel bar 11 is retreated while the tube blank 30 is rolled by the extractor 20, thereby performing stripping.

In the methods of (2) and (3) described above, it takes time for moving the extract fork 14 from a retreat position to a predetermined position, and for moving the tube blank 30 with the mandrel bar 11. Moreover, the temperature of the tube blank 30 becomes lower while moving. Such a temperature drop causes a thermal contraction of the tube blank 30 so that the stripping becomes difficult to be performed when the overlap (overlapped portion between the tube blank 30 and the mandrel bar 11) is long. In particular, when the tube blank 30 is made of a material that exhibits a large thermal contraction as temperature decreases (for example, an alloy steel with a Cr content of not less than 10% by mass), the stripping may become impossible.

Therefore, as shown in FIG. 2D it is necessary to shorten the overlap during or after rolling. As a method of shortening the overlap, there is a method of reducing the moving speed of the mandrel bar 11 during rolling to be lower than the moving speed of the tube blank 30. However, reducing the moving speed of the mandrel bar 11 results in an increase in speed difference between the mandrel bar 11 and the tube blank 30 and there arises a problem such that the mandrel bar 11 is more liable to be damaged due to friction with the tube blank 30 during rolling in the mandrel mill 10.

CITATION LIST

Patent Literature

Patent Literature 1: Japanese Patent Application Publication No. 7-214110

Patent Literature 2: Japanese Patent Application Publication No. 8-117816

Patent Literature 3: Japanese Patent Application Publication No. 8-300013

Patent Literature 4: Japanese Patent Application Publication No. 2001-205323

SUMMARY OF INVENTION

Technical Problem

It is an object of the present invention to provide a retract mandrel mill which does not require to prepare the tube blank to be subjected to the elongation-rolling, in a length in excess of what is needed as a product when producing a shorter-length product than usual, and which can suppress the wear of the mandrel bar. It is another object of the present invention to provide a method for rolling a tube blank by using the retract mandrel mill of the present invention.

Solution to Problem

The summary of the present invention is as follows.

(1) A retract mandrel mill, comprising a mandrel mill and an extractor, the mandrel mill including a mandrel bar and being configured to roll a tube blank into which the mandrel bar is inserted, the extractor being configured to extract the mandrel bar from the tube blank that completes the rolling in the mandrel mill, wherein the distance between the mandrel mill and the extractor is adjustable.

(2) A method for rolling a tube blank, wherein the retract mandrel mill according to the above-described (1) is used.

(3) The retract mandrel mill according to the above-described (1), or the method for rolling a tube blank according to the above-described (2), wherein the tube blank is made of a steel containing not less than 10% of Cr by mass.

Advantageous Effects of Invention

Since the distance between the mandrel mill and the extractor can be adjusted by using the retract mandrel mill of the present invention, the front end of the tube blank 30 can reach the extractor 20 after the completion of the rolling in the mandrel mill 10 even when a tube blank which is shorter than usual is rolled. This eliminates the need to add an extra extension to the length of the tube blank to be subjected to an elongation-rolling process, and the wear of the mandrel bar can be suppressed. According to the retract mandrel mill of the present invention and the method for rolling a tube blank of the present invention, therefore, it is possible to roll a tube blank efficiently and with high yields.

BRIEF DESCRIPTION OF DRAWINGS

FIG. 2 is a diagram to illustrate a state where a tube blank, which is shorter than the distance between a mandrel mill and an extractor, is rolled in a conventional retract mandrel mill, wherein

FIG. 3 is a configuration diagram of a retract mandrel mill of the present invention, in which

DESCRIPTION OF EMBODIMENTS

Figure 3A:
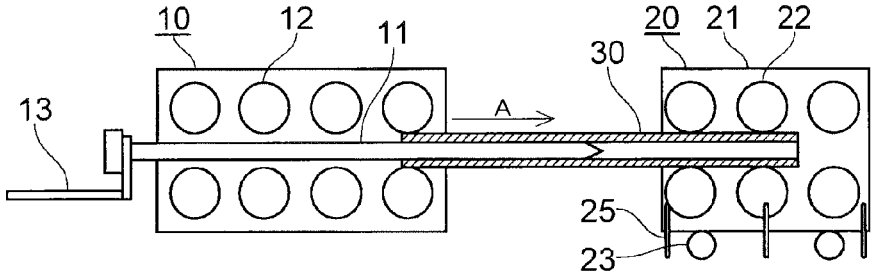
FIG. 3A shows a case where a tube blank of a normal length is rolled.
Figure 3B:
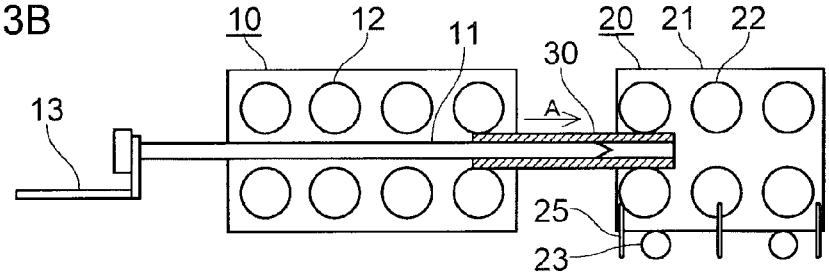
FIG. 3B shows a case where a tube blank, which is shorter than the distance between the mandrel mill and the extractor in FIG. 3A, is rolled.

FIG. 3 is a configuration diagram of a retract mandrel mill of the present invention. FIG. 3A shows a case where a tube blank of a normal length is rolled, and FIG. 3B shows a case where a tube blank, which is shorter than the distance between the mandrel mill and the extractor in FIG. 3A, is rolled. The retract mandrel mill shown in FIG. 3 has the same configuration as that shown in the above-described FIG. 1, and substantially same parts are given the same reference symbols, excepting that the extractor is movable in parallel with the rolling direction (in the direction indicated by the arrow A).

In the present embodiment, as shown in FIG. 3, the extractor 20 is provided with wheels 23 beneath a housing 21, and is movable over a rail 24 of the floor surface in parallel with the rolling direction of the moving tube blank 30. Thereby, the distance between the mandrel mill 10 and the extractor 20 is changeable.

Figure 4:
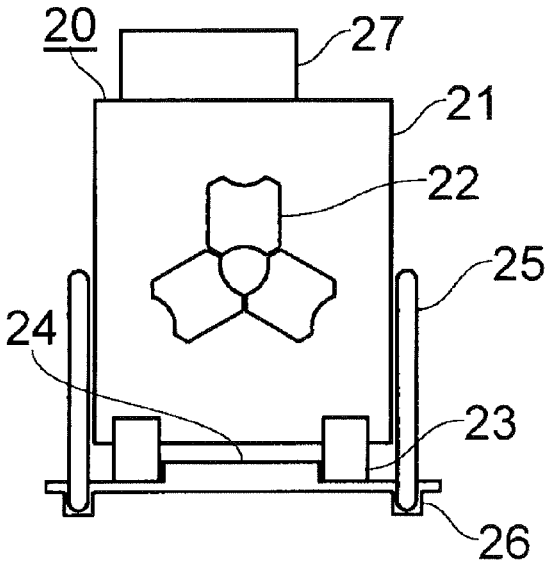
FIG. 4 is a diagram to illustrate one example of the method for moving the extractor.

FIG. 4 is a diagram to illustrate one example of the method of moving the extractor.

For example, as a method of moving the extractor 20, listed are following four methods.

(1) As shown in FIG. 4, a motor 27 for driving the rolls 22 and the wheels 23 is installed on a pedestal of the housing 21 so as to move with the extractor 20.

(2) A motor (not shown) for driving the rolls 22 is provided separately from the extractor 20, and the driving shaft of the motor (not shown) is connected with the driving shafts of the rolls 22 and the wheels 23 with a universal joint.

(3) A motor (not shown) for driving the rolls 22 is provided separately from the extractor 20 so that power transmission from the driving shaft of the motor (not shown) to the driving shafts of the rolls 22 and wheels 23, which are provided at each position to which the extractor 20 moves, is performed by switching gears with a clutch.

(4) A driving apparatus similar to the restraint mechanism 13 of the mandrel bar 11 is installed on the exit side (downstream side) of the extractor 20 to move the extractor 20 by the same driving method as that for moving the mandrel bar 11. In this case, the driving of the rolls 22 is performed by using any of the methods of (1) to (3) described above.

In the methods of moving the extractor 20 described above, each of the methods of (1) to (3) described above is a method of transferring the rotational force of the motor to the rolls 22 and the wheels 23, and the method of (4) is a method of moving the main body of the extractor 20 in the advancing or retreating direction in parallel with the rolling direction.

According to the moving method shown in FIG. 4, the housing 21 is provided with anchors 25 on each side thereof with respect to the rolling direction. While the extractor 20 is in operation, the anchors 25 are inserted into insertion ports 26 provided on the floor. And when the extractor 20 is moved, the anchors 25 are pulled out from the insertion ports 26. Inserting the anchors 25 into the insertion ports 26 can prevent the extractor 20 from being moved by the thrust force during rolling the tube blank 30.

Figure 1:
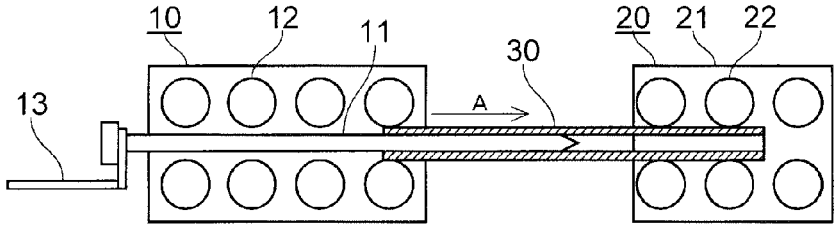
FIG. 1 is a configuration diagram of a conventional retract mandrel mill.
Figure 2A:
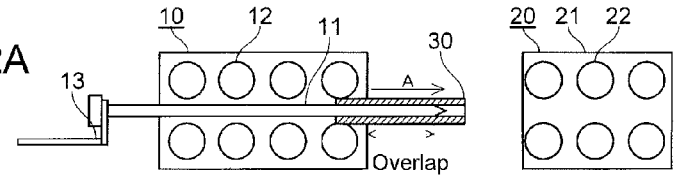
PRIOR ART FIG. 2A
FIG. 2A shows a state of rolling procedure at the mandrel mill.
Figure 2B:
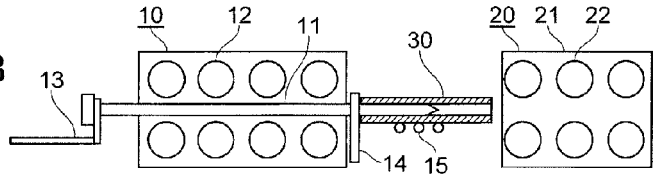
PRIOR ART FIG. 2B
FIG. 2B shows a state where stripping is performed by using an extract fork.
Figure 2C:
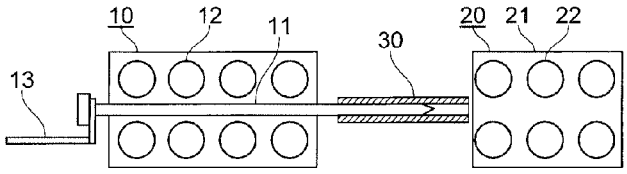
PRIOR ART FIG. 2C
FIG. 2C shows a state where the tube blank after the rolling in the mandrel mill is moved by a mandrel bar.
Figure 2D:
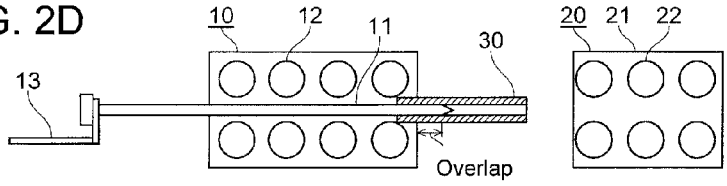
PRIOR ART FIG. 2D
FIG. 2D shows a state where the overlap between the mandrel bar and the tube blank is reduced.

When a tube blank of a regular length is rolled by using the retract mandrel mill of the present embodiment, the distance between the mandrel mill 10 and the extractor 20 is set at a predetermined spacing as shown in FIG. 3A (for example, in a similar manner to the case shown in FIG. 1 described above). When the tube blank 30 is being rolled, since the mandrel bar 11 can be brought close to the extractor 20 while it is moved at a regular speed, that is, with the speed difference between the tube blank and the mandrel bar being reduced, the damage to the mandrel bar 11 due to friction with the tube blank 30 is incurred in the least.

When a tube blank 30 which is shorter than the distance between the mandrel mill 10 and the extractor 20 and is set at a predetermined spacing is rolled, the extractor 20 is moved in the direction to approach the exit side of the mandrel mill 10 so that the distance between the mandrel mill 10 and the extractor 20 is shortened as shown in FIG. 3B.

As a result, when rolling a short tube blank 30, the mandrel bar 11 can be moved at a regular speed as in the case where a tube blank of regular length is rolled, thereby reducing the speed difference between the tube blank and the mandrel bar so that the damage to the mandrel bar 11 due to friction with the tube blank 30 can be controlled in the least. Moreover, since the rolling of the tube blank 30 in the extractor 20 has started when the rolling of the tube blank 30 in the mandrel mill 10 completes, the mandrel bar 11 can be extracted from the tube blank 30 without any problem, and there is no need of preparing the tube blank 30 to be subjected to an elongation-rolling process to have a length in excess of what is needed as a product.

EXAMPLES

To confirm advantageous effects of the present invention, a rolling testing of tube blanks was conducted as described below.

1. TESTING METHOD

A conventional retract mandrel mill was used as Comparative Example, in which no adjustment of the distance between the mandrel mill and the extractor was performed. The retract mandrel mill of Comparative Example was designed to be able to roll a tube blank having a length of 25 m after rolling. The traveling speeds of tube blank at the entrance and exit of the mandrel mill were set at values shown in Table 1. In this case, time required for rolling a single tube blank was 8.33 sec (rolling length 25 m divided by tube blank exit speed 3.0 m/sec).

TABLE 1

| Tube blank speed (m/sec) | | |
|---|---|---|
| Mandrel mill entrance | Mandrel mill exit | Mandrel bar speed (m/sec) |
| 1.2 | 3.0 | 1.0 |

To that end, when the position of the mandrel bar is controlled such that the front end of the mandrel bar be located immediately under the final rolls at the start of the rolling in these rolls of the mandrel mill, the front end of the mandrel bar moves toward the entrance side of the extractor by 8.33 m when the rolling of the tube blank in the mandrel mill completes (mandrel bar speed 1.0 msec times rolling time in final rolls 8.33 sec).

Thus, in the retract mandrel mill of Comparative Example, the distance between the mandrel mill and the extractor was set at 8.4 m such that the front end of the mandrel bar would not intrude into the extractor.

In contrast to the retract mandrel mill of Comparative Example, the retract mandrel mill of Inventive Example of the present invention was configured such that the extractor was movable in parallel with the rolling direction. In the retract mandrel mill of Inventive Example of the present invention, it was arranged such that the distance between the mandrel mill and the extractor was changeable by 3.0 m at the maximum. Specifically, it was arranged such that the distance had a standard value of 8.4 m, and was changeable up to 5.4 m which was 3.0 m shorter than the standard value. Excepting those described above, the length of tube blank that can be rolled, and the speed of the tube blank were the same as those of Comparative Example.

Three anchors were provided at a spacing of 2 m on each side of the housing of the extractor along the rolling direction. Since the force of the extractor to pull the tube blank was about 10 tons, each anchor was designed to be able to bear a thrust force of 2 tons.

In the present examples, the tube blank was made of a plain steel (C: 0.2% by mass) and an alloy steel (C: 0.2% by mass, Cr: 13% by mass). Further, the rolled size of the tube blank was an outer diameter of 245 mm and a wall thickness of 14 mm.

Regarding the length of the tube blank, supposing that the lengths of product steel tubes be 6 m, 12 m, 18 m, and 24 m, the lengths of tube blanks after rolling were set to be 6.5 m, 12.5 m, 18.5 m, and 25 m.

2. TESTING RESULTS

2-1 Plain Steel

Comparative Example

When the plain steel was used for the tube blank, the retract mandrel mill of Comparative Example was able to roll any of the tube blanks having lengths of 6.5 m, 12.5 m, 18.5 m, and 25 m. When rolling tube blanks of 12.5 m, 18.5 m, and 25 m which were longer than the distance (8.4 m) between the mandrel mill and the extractor, the speed of the mandrel bar was set at 1.0 m/s as listed in Table 1.

When rolling a tube blank of 6.5 m which was shorter than the distance between the mandrel mill and the extractor, the speed of the mandrel bar was set at less than 1.0 m/s. In this case, the stripping of the tube blank was conducted by advancing the mandrel bar after the rolling in the mandrel mill to make the tube blank intrude into the extractor, or by using an extract fork. This was because setting the speed of the mandrel bar at 1.0 m/sec would result in an excessive overlap between the mandrel bar and the tube blank thereby making the stripping difficult.

Inventive Example of the Present Invention

The retract mandrel mill of Inventive Example of the present invention was able to roll any of the tube blanks having lengths of 6.5 m, 12.5 m, 18.5 m, and 25 m as well with the distance between the mandrel mill and the extractor being kept at 8.4 m, by adjusting the speed of the mandrel bar as in Comparative Example.

When rolling a tube blank having a length of 6.5 m by using the retract mandrel mill of Inventive Example of the present invention, the rolling was successfully performed with the speed of the mandrel bar being set at 1.0 m/sec by shortening the distance between the mandrel mill and the extractor to 5.4 m. In this case, since the speed difference between the tube blank and the mandrel bar was small, the damage to the mandrel mill bar due to the friction with the tube blank was much less than in the case where the distance between the mandrel mill and the extractor was kept at 8.4 m.

2-2. Alloy Steel

Comparative Example

When the alloy steel was used for the tube blank, the retract mandrel mill of Comparative Example was able to roll the tube blanks of 12.5 m, 18.5 m, and 25 m under the same condition as in the case of the plain steel.

However, it was unable to roll the tube blank having a length of 6.5 m. This was because the thermal contraction rate of the tube blank was large, and when advancing the mandrel bar after the rolling in the mandrel mill, or while moving the extract fork to a predetermined position, the tube blank contracted thereby disabling the stripping.

Inventive Example of the Present Invention

Meanwhile, the retract mandrel mill of Inventive Example of the present invention was able to roll any of the tube blanks having lengths of 6.5 m, 12.5 m, 18.5 m, and 25 m.

It was possible to roll the tube blanks having lengths of 12.5 m, 18.5 m, and 25 m with the distance between the mandrel mill and the extractor being kept at 8.4 m, under the same condition as that of Comparative Example. It was possible to roll the tube blank having a length of 6.5 m with the speed of the mandrel bar being set at 1.0 msec by shortening the distance between the mandrel mill and the extractor to 5.4 m.

3. CONCLUSION AND SUPPLEMENT

It is seen from the results of the above-described examples that according to the present invention, it is possible to produce tube blanks having a length in the range of 6.5 m to 25 m by a single retract mandrel mill even if the tube blank is made of a material having a large thermal contraction rate.

Further, supplementing about the setting of the distance between the mandrel mill and the extractor, in the above-described examples, the retract mandrel mill was set up such that the distance between the mandrel mill and the extractor had a standard value of 8.4 m, to enable the rolling of a tube blank having a length of 25 m after rolling.

Similarly, to enable the rolling of a tube blank having a length of 18 m after rolling, the standard value for the distance between the mandrel mill and the extractor was set at 6.0 m (mandrel bar speed 1.0 msec times (rolling length 18 m divided by tube blank exit speed 3.0 m/sec)).

Further, to enable the rolling of a tube blank having a length of 32 m after rolling, the standard value for the distance between the mandrel mill and the extractor was set at 10.7 m (mandrel bar speed 1.0 m/sec times (rolling length 32 m divided by tube blank exit speed 3.0 msec) equals or nearly equals 10.67 m).

INDUSTRIAL APPLICABILITY

The present invention is applicable to the rolling of tube blanks, such as the production of seamless tubes through the application of the Mannesmann process, and the like.

REFERENCE SIGNS LIST

10: Mandrel mill, 11: Mandrel bar, 12: Roll,
13: Restraint mechanism, 14: Extract fork, 15: Conveyor roll,
20: Extractor, 21: Housing, 22: Roll, 23: Wheel,
24: Rail, 25: Anchor, 26: Insertion port,
27: Motor, 30: Tube blank

What is claimed is:

1. A retract mandrel mill, comprising a mandrel mill and an extractor, the mandrel mill including a mandrel bar and being configured to roll a tube blank into which the mandrel bar is inserted, the extractor being configured to extract the mandrel bar from the tube blank that is rolled in the mandrel mill, the extractor further comprising a housing with wheels beneath the housing, wherein the housing with wheels permits the extractor to move with respect to the mandrel mill so that a distance between the mandrel mill and the extractor is adjustable, the distance being measured horizontally.

2. A method for rolling a tube blank, wherein the retract mandrel mill according to claim 1 is used.

3. The method for rolling a tube blank according to claim 2, wherein the tube blank is made of a steel containing not less than 10% of Cr by mass.

4. The retract mandrel mill according to claim 1, wherein the tube blank is made of a steel containing not less than 10% of Cr by mass.

* * * * *